United States Patent [19]

Bremer et al.

[11] 4,348,940

[45] Sep. 14, 1982

[54] SERVO-RELEASE MECHANISM FOR AN AUTOMATIC WEAPON

[75] Inventors: Clemens Bremer; Walter Klumpp, both of Duesseldorf, Fed. Rep. of Germany

[73] Assignee: Rheinmetall GmbH, Duesseldorf, Fed. Rep. of Germany

[21] Appl. No.: 63,388

[22] Filed: Aug. 28, 1979

[30] Foreign Application Priority Data

Aug. 3, 1978 [DE] Fed. Rep. of Germany ..... 2833976

[51] Int. Cl.[3] ..... F41D 11/02

[52] U.S. Cl. ..... 89/140

[58] Field of Search ..... 89/125, 132, 140

[56] References Cited

U.S. PATENT DOCUMENTS 4,210,059 7/1980 Munn ..... 89/132

FOREIGN PATENT DOCUMENTS 2432699 2/1980 France .

*Primary Examiner*—Stephen C. Bentley

[57] ABSTRACT

The breech of a gun moves in opposite, recoil and counter-recoil directions along a guide path. A rotatable coupling member having a first interlocking end is mounted along the fixed structure of the gun. The gun is selectively activated by a rotatable key member aligned with the coupling member, the key member having a second interlocking end adapted to interfit with the first interlocking end on the coupling member. The key member can be axially slid with respect to the coupling member to assume an on-position when it is disengaged from the coupling member, an off-position when it is drivingly engaged with the coupling member, and an intermediate position when only the end surfaces of the interlocking ends of the coupling member and key member are in engagement. Release of the mechanism from the on-position induces the key member to move into the intermediate position, and the counter-recoil motion of the breech induces the key member to move from its intermediate position into its off-position. The mechanism provides for the safe activation and deactivation of an automatic weapon.

26 Claims, 2 Drawing Figures

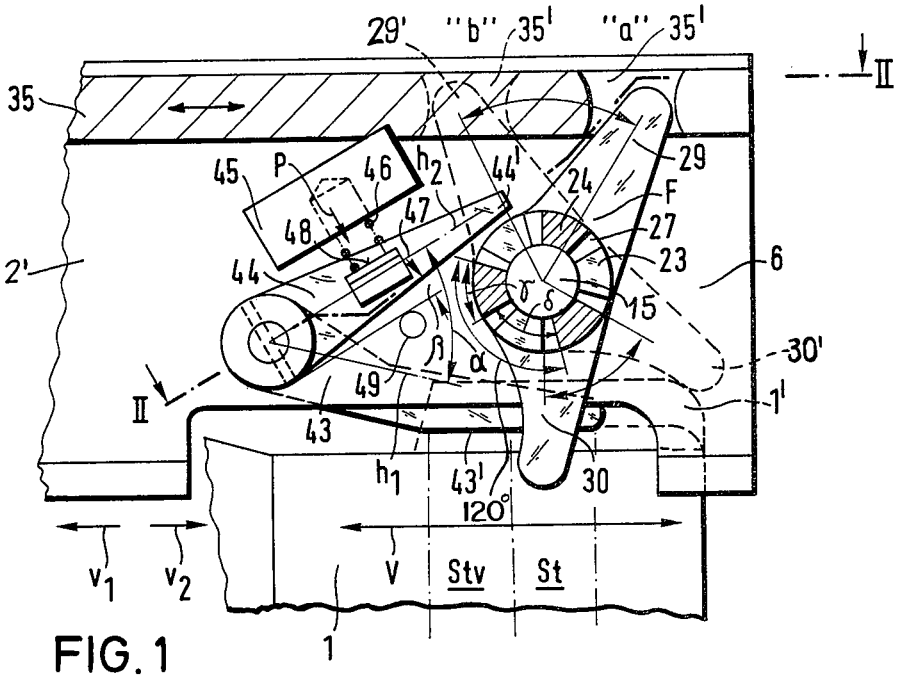
FIG. 1
FIG. 2
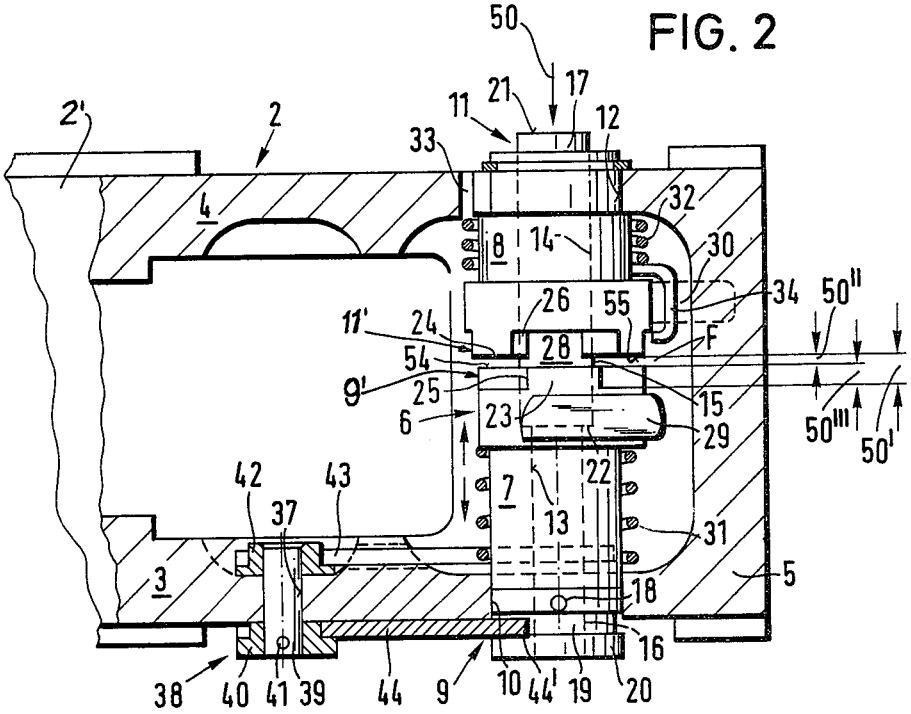

SERVO-RELEASE MECHANISM FOR AN AUTOMATIC WEAPON

BACKGROUND OF THE INVENTION

1. Field of the Invention

The present invention relates to an improved servo-release mechanism for an automatic firearm, such mechanism including an operating train of elements including means positively locking such train in its off-position.

2. Description of the Prior Art

It is desirable in automatic weapons to provide for full surface engagement of corresponding parts in the servo-release mechanism in the trigger breech block region to provide for the safe locking of the breech in its off-position wherein the firing of the weapon is interrupted. The large acceleration forces which are generated during the firing of the gun can damage the edges of the confronting controllable parts of the mechanism and render them useless when no full surface engagement of such parts is provided. This can result in considerable interference with the firing of the weapon. For example, it may not be then possible to provide single shot firing of the weapon. Further, bursts of fire can not be reliably terminated with an arbitrarily introduced signal for fire interruption. In extreme cases, this can result in the unintentional complete emptying of the ammunition supply of the weapon, as well as creating a condition involving considerable danger.

The problem of full surface engagement of corresponding parts in the train of a servo-release mechanism for an automatic firearm is mentioned in German patent DE-OS No. 2323 352, which discloses a trigger mechanism for automatic weapons. The same problem appears in connection with the servo-trigger according to German patent application P27 42 241.9, which corresponds to the co-assigned U.S. patent application of Munn, Ser. No. 943,643, filed Sept. 19, 1978 now U.S. Pat. No. 4,210,059.

SUMMARY OF THE INVENTION

1. Purposes of the Invention

It is an object of the invention to provide a trigger mechanism for an automatic weapon with full surface engagement of the parts in order to avoid damage to the trigger mechanism during the operation of the weapon.

It is another object of the invention to provide a safe trigger mechanism which cannot be activated by mechanical shock or vibration.

These and other objects and advantages of the present invention will become evident from the description which follows.

2. Brief Description of the Invention

A kinematic chain of a servo trigger in a gun comprises a breech capable of recoil and counterrecoil motion in opposite directions along a guide path. The guide path has a precontrol region and a control region. In one aspect of the invention, there is a key member rotatable about an axis, the key member having the reference surface disposed in a plane normal to said axis, and a locking surface in the form of teeth. A rotatable coupling member disposed coaxial of the key member has a reference surface on the end thereof confronting the reference surface of the key member, and disposed in a plane normal to the axis of the key member, and a locking surface which is adapted selectively to mate with the locking surface on the key member. Means is provided for generating a precontrol signal upon a "stop firing" signal and the passage of the breech moving in the recoil direction through the precontrol region of the guide path of the breech. Another means provides a precontrol position upon receiving a precontrol signal from the means which generates the precontrol signal. The precontrol position is caused by a restoring force which generates a first change in the relative axial positions of the key member and the coupling member to cause a sliding contact between the reference surfaces of such members. The sliding contact of the reference surfaces is disengaged by means acting upon counterrecoil motion of the breech and its passage through a control region, while a defined relative angular position of the key member and of the coupling member so as to interlock them is produced. A locking position with full surface engagement of the locking surfaces is provided by means acting upon loss of contact between the reference surfaces and producing a relative axial motion of the key member and the coupling member toward each other.

In a second aspect of the invention, the coupling member is resiliently attached to the gun and is provided with an interlocking end. The key member activates the gun and is provided with an interlocking end adapted to interfit with the interlocking end of the coupling member. The key member has an on-position in which it is disengaged from the coupling member, an off-position in which it is engaged with the coupling member, and an intermediate position. The release of the on-position of the key member induces the key member to move into its intermediate position. The key member in the intermediate position is induced to move into the off-position by the counterrecoil motion of the breech.

The kinematic chain of the mechanism is preferably employed in an automatic weapon or machine gun. The coupling member and the key member preferably have their common axis disposed normal to the direction of firing of the gun and are rotatable about their common axis. The key member is movable in the direction of a first resilient restoring force, preferably in the form of a helical compression spring. The key member and the coupling member mesh over a limited angular extent to form a locked driving engagement therebetween. The coupling member has attached thereto a first member, which protrudes into the path of movement of the breech. The first member rotates with the coupling member and, upon counterrecoil motion of the breech, the key member can interlock with the coupling member. The intermediate position of the key member provides for the sliding rotating contact between the key member and the coupling member over an extended angle. The sliding contact surfaces of the key member and of the coupling member have recesses therein suitable for mutual interlocking. When the sliding, rotating surfaces engage each other over a limited angular extent, the first restoring force induces the key member to engage the coupling member in an interlocked position corresponding to the off-position of the key member. The interlocked portions of the key member and the coupling member provide full surface engagement between the key member and the coupling member.

A precontrol member can be provided which protrudes into the path of the breech, and which is movable against a second resilient restoring force. A detent can be provided, which is engaged with a precontrol member, and which can selectively prevent axial motion of the key member. Both the precontrol member and the detent can be levers. The end of the precontrol lever can be a runner for contacting the breech. The key member can also be provided with a recess for receiving the free end of the detent lever. The detent lever can further be provided with a surface which receives the second resilient restoring force.

In the embodiment shown, a shaft supporting the key member is rotatably mounted in a wall of a trigger casing. The precontrol lever and the detent lever are attached to a shaft journalled in the trigger casing, and the detent lever is located on the outside of said wall. A first hub is provided for mounting the precontrol lever on its shaft, and a second shaft is provided for mounting the detent lever on the shaft. Such hubs can be made removable from their mounted shaft. A second member can be attached to the coupling member, said second member engaging a movable control member for controlling a trigger lever. The angular position of the coupling member is restored by means of a helical torsion spring.

The on-position of the key member preferably is the firing position while the intermediate position of the key member can be the "stop firing" signal, and the off-position of the key member can be the "fire off" signal.

The "stop firing" signal and the passage of the breech in the recoil direction along the guide path through a precontrol region together generate a precontrol signal. The precontrol signal by means of the compression spring induces the first change of the mutual axial positions of the reference end surfaces of the key member and of the coupling member whereby these reference surfaces are brought into sliding contact.

Counter-recoil motion of the breech and passage of the breech through a control region results in the production of the limited angular position for providing locking between the key member and the coupling member, and the two reference surfaces lose their contact. The compression spring now induces a second change in the relative axial positions of the key member and the coupling member upon the loss of contact between the reference surfaces and a full surface engagement of the surfaces results in which there is positive locking between the key member and the coupling member with full surface engagement of their locking surfaces.

The present invention is to be employed preferably with the kinematic chain of the servo trigger mechanism disclosed in U.S. patent application of Munn, Ser. No. 943,643, above referred to, and can advantageously be applied for such kinematic chains of existing equipment. Furthermore, the present invention employs simply mechanical means.

The invention accordingly consists in the features of construction, combination of elements, and arrangement of parts which will be exemplified in the device hereinafter described.

BRIEF DESCRIPTION OF THE DRAWING

In the accompanying drawings, in which there is shown one of the various possible embodiments of the invention:

FIG. 1 is a view in longitudinal axial section of a servo-release mechanism for the trigger of an automatic weapon, certain of the parts being shown in elevation; and FIG. 2 is a view in section of the mechanism shown in FIG. 1, the section being taken along the broken section line II—II in FIG. 1.

GENERAL DESCRIPTION OF THE PREFERRED EMBODIMENT

As shown in FIG. 1 of the drawings, a breech or breech block 1 of an automatic weapon is mounted on fixed structure 2', including a barrel (not shown) of the weapon. The breech 1, which has a shift interlock 1' fixedly secured thereto, reciprocates with respect to structure 2' along the path V, forwardly in the counter-recoil direction $V_1$ and rearwardly in the recoil direction $v_2$. The structure 2' has a trigger casing 2 affixed thereto, the trigger casing having a left wall 3 (FIG. 2), a right wall 4, and a rear wall 5. A control element 35 is mounted in a guideway in the upper part of the fixed structure 2, 2' for reciprocation between a rearward "fire" position a and a forward "not fire" position b.

A controllable coupling 6 having a left half 7, referred to above as a key member, and a right half 8, referred to above as a coupling member, is disposed within the trigger casing 2, the two coupling halves being mounted on a cross shaft 15 which is journalled in the opposite side walls 3 and 4 of the trigger casing. The right half 8 of the coupling 6 is mounted for rotation with respect to shaft 15 and is held against axial movement, but the left half 7 of the coupling 6 although freely rotatable with respect to the shaft 15 is selectively movable from an axially outermost position, shown in FIG. 2, wherein it is entirely out of engagement with coupling half 8, to an axially intermediate position in which broad end surfaces of the coupling halves are in face-to-face engagement, and further to an axially innermost position wherein similar tooth-like formations on the inner confronting ends of the coupling halves are in fully-meshed, driving engagement.

Affixed to the left coupling half 7 there is a first, single-armed lever 29 the upper, outer end of which protrudes into and drivingly engages an arcuately-walled opening 35' in the control element 35. Affixed to the right coupling half 8 there is a second single-armed lever 30 which is engaged by the shift interlock 1' upon recoil movement of the breech 1 in the direction $v_2$ as shown in dash lines in FIG. 1. The levers 29 and 30 are shown in full lines in FIG. 1 in their clockwise terminal positions, and in dash lines in their counterclockwise terminal positions, where they are designated 29' and 30', respectively.

The right coupling half 8 and the lever 30 affixed thereto are constantly urged in a clockwise direction by a coil torsion spring 32. The left-hand coupling half 7 and the lever 29 affixed thereto are constantly yieldably urged upwardly (FIG. 2) by a coil compression spring 31. A mechanism 38 coacts with the coupling 6, in a manner to be described in detail below. Briefly, mechanism 38 includes a shaft 39 which is journalled in the left side wall 3 of the trigger casing 2, shaft 39 having two angularly spaced rearwardly extending single-armed levers 43 and 44 affixed thereto. Levers 43 and 44 are constantly yieldably urged toward their clockwise terminal positions by a coil compression spring 46 shown in FIG. 1. In its clockwise terminal position, shown in FIG. 2, after shaft 15 has been thrust downwardly after firing by a force directed upon the right-hand end surface 21 of such shaft completely to separate coupling halves 7 and 8 the rear end 44' of lever 44 engages the axially inner surface of a collar 20 on the left-hand end of the shaft 15 thereby to hold coupling half 7 in such disengaged position. The end 44' of lever 44 is removed from engagement with the collar 20 when breech 1 recoils in direction $v_2$, during which movement runner surface 43' on the bottom of lever 43 is engaged by the breech 1 so as to turn the shaft 39 and the lever 44 counterclockwise to raise end 44' of lever 44 into the position thereof shown in FIG. 1. This frees the shaft 15 and the coupling half 7 secured thereto for selective upward (FIG. 2) movement into their intermediate position and into the axially innermost or uppermost position of coupling half 7.

Detailed Description of the Preferred Embodiment

The left half 7 of the coupling 6 has an outer end 9 journalled in a bearing bore 10 in the left wall 3 of the trigger casing. The coupling member 8 has an outer end 11 which is journalled in the right wall 4 of the trigger casing. The left-hand coupling member 7 is provided with a central bore 13 and the right-hand coupling member 8 is provided with a central bore 14, both central bores being in alignment. The shaft 15 passes through the bores 13 and 14; the left end of the coupling half 7 is pinned to the left end 16 of the shaft 15 by a cross pin 18. The right-hand end 17 of the shaft 15 protrudes beyond the outer end 11 of the coupling half 8 and is provided with an outer end face 21. The coupling half 8 and the shaft 15 can be rotated relative to each other. Further, the shaft 15 can be moved in the direction of its axis through a predetermined distance. A step 22 of the shaft 15 corresponds to a step (not designated) in the bore 13. In the region of the outer end 9 of the left-hand coupling half 7 there is provided a circular groove 19 and next to it a collar 20 forms the outer end of the coupling half 7. The coupling halves 7 and 8 have confronting inner ends 9' and 11', respectively, provided with mating interlocking formations F disposed on similar coaxial circles. The interlocking means on coupling half 7 comprises teeth 23 separated by broad gaps or intervals 27, and the interlocking means on coupling half 8 comprises teeth 24 separated by gaps or intervals 28. The innermost ends 54 of the teeth 23 on coupling half 7 and the innermost ends 55 of the teeth 24 on coupling half 8 lie in planes normal to the axis of the shaft 15 and of the coupling halves. The surfaces 54 and 55 constitute reference or precontrol surfaces, and the teeth 23 and 24 form locking surfaces 25 and 26. The precontrol surfaces 54 and 55 face each other for a preset mutual contact. Each tooth 23 and 24, which is disposed upon a circle, covers with its respective precontrol surface 54 and 55 a central angle $\gamma$ (FIG. 1) of 45° is completed to equalling 120° by a complementary angle $\delta$ there shown to extend between corresponding faces of the respective interspace 27 and 28.

The lower end of the above-described lever 30 protrudes into the guide path V of the breech 1 in a control region St when the lever 30 is in its full-line position shown in FIG. 1. The torsion spring 32 is in the form of a helix telescoped about the right-hand coupling half 8 and is connected at its outer end 33 to the wall 4 of the casing 2, the inner end of spring 32 being in the form of a hook which fits about the radially inner end of the lever 30.

The control element 35 is constantly urged rearwardly (to the right in FIG. 1) by a spring (not shown). Control element 35 moves parallel to the recoil and counter-recoil motion of the breech 1 from its rear "fire" position a into its front "not fire" position b. In its rear position a the control element 35 sets a trigger lever (not shown) in a position for release of the breech 1 for firing a single round or for continuous fire. In its front position b the control element 35 sets the trigger lever in an engaged position with the breech 1.

The above-described compression spring 31 is telescoped about the left-hand coupling half 7, the outer end of the spring 31 engaging the inner surface of the left wall 3 of the trigger casing and the inner end of spring 31 engaging the spring seat on coupling half 7.

The Precontrol Signal Mechanism 38

The rotatable shaft 39 of the mechanism 38 is journalled in a bore 37 in the left wall 3 of the trigger casing 2. An outer hub 40 is connected to shaft 39 by a cross pin 41, and an inner hub 42 is demountably affixed to the shaft by means not shown. The control lever 43 is attached to the hub 42, and the detent lever 44 is attached to the hub 41. The runner 43' on the bottom of control lever 43 extends through a precontrol region Stv. As above-noted, the runner 43' protrudes into the guide path V of the breech 1 and is upwardly deflectable thereabout. The detent lever 44 extends along the outside of the left-hand side wall 3 of the trigger casing 2. The levers 43 and 44 are disposed at an angle $\alpha$ between their longitudinal axes. On the outside of the wall 3 of the trigger casing there is provided a spring support 45 for the compression spring 46 which exerts a force in the direction of the arrow P upon the detect lever 44. The other end of the spring 46 is supported by the stop face 48 of a bearing bracket 47 mounted on the outside of the detent lever 44. A catch pin 49 protruding from the outside of the wall 3 limits the clockwise turning of the lever 44. The specific manner of operation of the mechanism 38 will be apparent in the following description of the operation of the servo-release mechanism as a whole.

The Manner of Operation of the Servo-Release Mechanism of the Invention

Continuous Fire

It will be assumed that the breech 1 is in its rear (right) position as shown in FIG. 1. The left-hand half 7 and the right-hand half 8 of the coupling 6 are in a mutually interlocking position. In this position the lever 30 is in its dash line (30') position and rests upon a shift interlock 1' of the breech 1. The lever 29 (in its 29' position) retains the control element 35 in its front (left) position against the force of the spring which thrusts it to the right in the direction of the arrow $v_2$. As mentioned above, in the front position of the control element 35 the breech 1 is engaged with the set trigger lever (not shown). For firing, a release force impacts on the outer surface 21 of shaft 15 in the direction of arrow 50. This thrusts the coupling half 7 against the restoring force of the compression spring 31 to the left (downwardly in FIG. 2) through a distance 50' so that the interlock between the coupling halves 7 and 8 is disconnected.

Such action results in the following: The control element 35 is moved in the direction of the arrow $v_2$ by its restoring spring and at the same time moves the lever 29 forward the wall 5 of the trigger casing 2 and the trigger lever leaves the position in which it is engaged with the breech 1 and releases the breech so that it can travel in the counter-recoil direction $v_1$. This step causes the lever 30 and the control lever 43 to lose their support on the shift interlock 1'. The restoring force of the torsion spring 32 induces the lever 30 to turn in the direction of the arrow $v_1$ into the guide path V of the breech 1. The detent lever 44 is pressed down into the groove 19 on the shaft 15 by means of the restoring of the spring 46 and locks the left coupling half 7 in the disengaged position thereof shown in FIG. 2. A first firing cycle is performed and is entered with the return of the breech 1 moving in the direction $v_2$ at the rear end of the guide path V. At the end of such guide path, the shift interlock 1' deflects the lever 30 and the control lever 43, and by means of the latter the detent lever 44 is deflected. Since the release force continues to impact upon the surface 21 of the shaft 15 in the direction of the arrow 50, the left coupling half 7 remains in its disengaged position as shown in FIG. 2 and the desired number of firing cycles follows.

Interruption of Firing

In order to interrupt the firing, the release force acting in the direction of the arrow 50 is removed from the shaft 15. At this moment, for example, the breech 1 is in its recoil motion in the direction of the arrow $v_2$. When the shift interlock 1' passes under the control lever 43, the turning of the control lever 43 removes the detent 44 from the groove 19. The restoring force of the compression spring 31 is not compensated at this time with the release force, and the compression spring 31 thrusts the coupling half 7 to the right through a distance 50''. This brings the precontrol surfaces 54 into contact with the precontrol surfaces 55 of the coupling half 8. The detent lever 44 rests at this time on the collar 20. When the breech reaches the control region St with its shift interlock 1', the lever 30 is turned toward the rear wall 5 of the trigger casing 2.

During the first part of this turning motion, the precontrol surfaces 54 and 55 are in sliding contact. Only when the breech 1 after passing its return point on the guide path again starts its counter-recoil motion in the direction of the arrow $v_1$ and when the lever 30 under the restoring force of the torsion spring 32 reaches a predetermined angular setting, do the precontrol surfaces 54 lose contact with the precontrol surfaces 55 and the compression spring 31 thrusts the coupling half 7 through a distance 50''' toward the right result in full surface engagement with the locking surfaces 25 and 26 whereby to interlock the coupling halves 7 and 8.

The two levers 29 and 30 now form a rigid unit. The restoring force of the torsion spring 32 moves the control element 35 in the direction of the arrow $v_1$ into its front position b and the control element 35 turns the trigger lever and passes under it so that the trigger lever now securely engages the breech 1. At this time, the lever 44 rests on the catch pin 49 and the free end 44' of the lever 44 is located on the outside and in front of the outer end 9 of the coupling half 7.

The Firing of a Single Shot

When a single shot is fired, the release force in the direction 50 on the outer face 21 of the shaft 15 is applied for only a very brief interval, such force thrusting the coupling half 7 out of disengagement with the coupling half 8. The procedure described in connection with a burst of fire is initiated, and proceeds in a corresponding manner. The breech 1 moves in the recoil direction $v_2$ and passes under the runner 43' of the control lever 43. The turning of the control lever 43 removes the detent lever 44 from the groove 19 so that the pressure spring 31 thrusts the coupling arm 7 toward the coupling arm 8 through a distance 50'' in order to provide contact between the precontrol surfaces 54 and 55. Upon recoil movement of the breech 1, the conditions described above are brought about by repositioning the lever 30, so that by means of full engagement of the mating surfaces 25 and 26 of the coupling 6 the breech 1 is securely locked after the termination of an individual firing cycle.

The above description of the invention demonstrates the advantages of the compulsory action of the mechanism 38 in its dependence upon the motion of the breech 1. By way of a space-saving construction, the servo-trigger of German patent application P No. 27 42 241.9 can be completed without any great cost. A demountable attachment of the two hubs 40 and 42 of the mechanism 38 allows their rapid mounting and dismounting, as necessary.

Although the invention is illustrated and described with reference to a single preferred embodiment thereof, it is to be expressly understood that it is in no way limited by the disclosure of such a single embodiment, but is capable of numerous modifications within the scope of the appended claims.

What is claimed is:

1. In a gun having a trigger, a servo-release mechanism for the trigger, and a breech movable along a guide path in a rearward, recoil direction and a forward counter-recoil direction, said guide path for the breech having a precontrol region, and a control region rearwardly of the precontrol region, the improved servo-release mechanism which comprises a disengageable coupling having first and second coaxial parts, the confronting ends of the first and second parts of the coupling each having a reference surface normal to the axis of the coupling and locking surfaces adaptable to interlock with each other, means forming a precontrol signal upon a "stop firing" signal and the passage of the breech moving in the recoil direction through the precontrol region of the guide path of the breech, means for providing a precontrol position of the coupling parts relative to each other upon receiving a precontrol signal, said precontrol position being caused by a restoring force generating a first change in the relative axial positions of the first and second parts of the coupling, in said precontrol position of the coupling the reference surfaces thereof having sliding contact with each other, means for removing the first and second parts of the coupling from engagement with each other upon counter-recoil motion of the breech and its passage through the control region and upon the presence of a defined relative angular position of the two parts of the coupling so that they may interlock with each other, and means for providing by a relative axial movement of the first and second parts toward each other a locking position of the coupling in which full surface engagement between the locking surfaces of the first and second coupling parts takes place with a consequent loss of contact between the reference surfaces thereof.

2. In a gun having a trigger, a servo-release mechanism for the trigger, and a breech movable along a guide path in a rearward, recoil direction, and a forward, counter-recoil direction, the improved servo-release mechanism which comprises a disengageable coupling having a first coupling part and a second coaxial coupling part, the two coupling parts being coaxial and relatively movable axially toward and away from each other, the confronting ends of each of the coupling parts having an interlocking formation, the first coupling part activating the gun and having an on-position when disengaged from the second coupling part, an off-position when fully engaged with the second coupling part, and an intermediate position wherein the release of the on-position induces the said first coupling part to move into the intermediate position, the said first coupling part when in the intermediate position being caused to move into the off-position by the counter-recoil breech position.

3. The combination as set forth in claim 2, wherein the gun is an automatic weapon.

4. The combination as set forth in claim 2, wherein the gun is a machine gun.

5. The combination as set forth in claim 2, wherein the axis of the coupling is disposed transverse to the longitudinal axis of the breech and the guide path of the breech.

6. The combination as set forth in claim 5, wherein the two parts of the coupling are rotatable about the axis of the coupling.

7. The combination as set forth in claim 6, wherein the said first coupling part is movable along the axis of the coupling.

8. The combination as set forth in claim 7, comprising a first resilient means which constantly urges the said first part of the coupling axially toward the second part of the coupling.

9. The combination as set forth in claim 8, wherein said first resilient means is a helical spring.

10. The combination as set forth in claim 8, wherein the first and second parts of the coupling mesh over a limited angular extent to form a locked engagement therebetween.

11. The combination as set forth in claim 10, further comprising a first member attached to the second part of the coupling and protruding into the path of the breech, whereby upon counter-recoil motion of the breech the first member and the second part of the coupling rotate to allow the first coupling part to interlock with the second coupling part.

12. The combination as set forth in claim 11, wherein when the first and second coupling parts are in their intermediate axial position with respect to each other there is provided a sliding rotating contact between the reference surfaces thereof over an extended angular extent.

13. The combination as set forth in claim 12, wherein the sliding rotating contact surfaces of the first and second parts of the coupling have interfitting formations adapted for the mutual interlocking of the two coupling parts.

14. The combination as set forth in claim 13, wherein the sliding rotating contact between the reference surfaces of the two coupling parts ceases after a predetermined angle of rotation therebetween, and wherein the first resilient means thrusts the first part of the coupling to move into an interlocked relationship with the second part of the coupling.

15. The combination as set forth in claim 11, comprising a helical torsion spring which opposes rotation of the first member and the second part of the coupling.

16. The combination as set forth in claim 15, wherein the interlocked position between the two parts of the coupling is provided by full surface engagement between the interlocking formations on the confronting ends thereof.

17. The combination as set forth in claim 11, further comprising a precontrol member which protrudes into the path of the breech and is movable from the recoil passage of the breech, and comprising a second resilient means for constantly opposing movement of the precontrol member by the breech in its recoil passage.

18. The combination as set forth in claim 17, further comprising a detent which is drivingly connected with the precontrol member and which locks the first part of the coupling member into its off-position, removed from engagement with the second part of the coupling when the detent is engaged by the breech.

19. The combination as set forth in claim 18, wherein the precontrol member is a lever, and wherein the detent is a lever.

20. The combination as set forth in claim 19, wherein the outer end of the lever constituting the precontrol member has a runner for contacting the breech, and wherein the said first part of the coupling is provided with a recess for receiving the free end of the detent lever when the said first part of the coupling is in its on-position.

21. The combination as set forth in claim 20, wherein the second resilient means constantly urges the detent away from the recess in the first part of the coupling.

22. The combination as set forth in claim 21, further comprising a trigger casing for the gun, the trigger casing having at least one wall, the said first part of the coupling being journalled in the casing, and a shaft journalled in the casing and having the precontrol lever and the detent lever secured thereto, the detent lever being located on the outside of said wall of the trigger casing.

23. The combination as set forth in claim 22, wherein the precontrol lever is attached to a first hub mounted on the shaft, and wherein the detent lever is attached to a second hub mounted on the shaft.

24. The combination as set forth in claim 23, comprising a second shaft secured to the said first part of the coupling and extending outwardly of the trigger casing, axial movement of said second shaft when the detent lever is withdrawn from the groove in the said first coupling part permitting the control of the axial position of the first coupling part by the second shaft.

25. The combination as set forth in claim 24, comprising a trigger lever engaging the second shaft, and a movable control lever for controlling the trigger level.

26. The combination as set forth in claim 25, wherein the on-position of the first part of the coupling generates the firing signal, and wherein the intermediate position of the first coupling part generates the stop firing signal.

* * * * *